US011141030B2

(12) United States Patent
Newham

(10) Patent No.: US 11,141,030 B2
(45) Date of Patent: Oct. 12, 2021

(54) SYSTEM AND METHOD FOR MONITORING THE PRESENCE OF A PERSON ON A TOILET

(71) Applicant: Paul Newham, Helotes, TX (US)

(72) Inventor: Paul Newham, Helotes, TX (US)

( * ) Notice: Subject to any disclaimer, the term of this patent is extended or adjusted under 35 U.S.C. 154(b) by 0 days.

(21) Appl. No.: 16/856,930

(22) Filed: Apr. 23, 2020

(65) Prior Publication Data

US 2021/0015313 A1 Jan. 21, 2021

Related U.S. Application Data

(60) Provisional application No. 62/837,718, filed on Apr. 23, 2019.

(51) Int. Cl.
*A47K 13/24* (2006.01)

(52) U.S. Cl.
CPC ..... *A47K 13/24* (2013.01)

(58) Field of Classification Search
CPC ..... A47K 13/24
USPC ..... 4/661
See application file for complete search history.

(56) References Cited

U.S. PATENT DOCUMENTS

| | | | | |
|---|---|---|---|---|
| 6,028,520 | A * | 2/2000 | Maehre | A47K 13/24 340/522 |
| 2007/0022522 | A1* | 2/2007 | Yu | A47K 13/24 4/237 |
| 2010/0083430 | A1* | 4/2010 | Chen | A47K 13/305 4/237 |
| 2020/0029907 | A1* | 1/2020 | Kobayashi | B60N 2/002 |

* cited by examiner

*Primary Examiner* — Huyen D Le
(74) *Attorney, Agent, or Firm* — Kammer Browning PLLC

(57) ABSTRACT

A sensor and a monitoring system for implementation on a toilet seat to detect: (a) the presence of an individual on the toilet seat; (b) the departure of the individual from the toilet seat; and (c) an overly long occupancy of the toilet seat by the individual. The sensor is incorporated either on the underside of the toilet seat or within the material structure of the seat. Included with the sensor in the system is an integrated interconnect component for allowing the operation of the dielectric shift sensor elements with a variety of control monitors associated with existing patient and nurse call alarm systems. The interconnect component and an appropriately structured interconnect cable are used to connect the dielectric shift sensor elements configured within or on the toilet seat with any of a variety of existing alarm/alert control unit modules.

2 Claims, 3 Drawing Sheets

SYSTEM AND METHOD FOR MONITORING THE PRESENCE OF A PERSON ON A TOILET

CROSS REFERENCES TO RELATED APPLICATIONS

This application claims the benefit under Title 35 United States Code § 119(e) of U.S. Provisional Patent Application Ser. No.: 62/837,718; Filed: Apr. 23, 2019; the full disclosure of which is incorporated herein by reference.

BACKGROUND OF THE INVENTION

1, Field of the Invention

The present invention relates generally to presence monitoring systems for individuals, especially systems directed to the safety of the elderly and/or those prone to accidents within a bathroom environment. The present invention relates more specifically to a system for monitoring the presence of an individual on a toilet seat, and/or the subsequent departure of the individual from the toilet seat.

2. Description of the Related Art

Most restroom or bathroom facilities configured for the safety of elderly individuals, or others prone to accidents or falls, provide little more than a "pull-cord" type alert system that the individual must affirmatively activate in order to alert a caregiver or family member of the need for help. In many cases, the individual is unable to reach the pull-cord alert system or is unconscious or otherwise unable to move after a fall. It would be helpful to have a passive system for monitoring the presence (or departure) of a person from a seated position on a toilet so as to alert caregivers or family members of the status of the individual, while still providing the individual with a measure of privacy while using the toilet. What passive systems that do exist are generally limited to the use of pressure switches positioned between the toilet seat and the toilet bowl. These systems suffer from all the same problems of any system using mechanical components that are subject to corrosion and deterioration. In addition, these pressure switch systems are difficult to keep clean and sanitary in the positions they are required to be placed in between the toilet seat and the toilet bowl rim. It would be desirable to have a monitoring system that does not rely on a mechanical switch and is not subject to contamination within an unsanitary environment.

The present invention is designed to work with components of caregiver alert systems already in use with beds and chairs. Some of these components are described in U.S. Patent Application Publication No. US 2017/0149432, the full disclosure of which is incorporated herein by reference. Additionally, the use of dielectric shift sensing elements in patient monitoring systems has been described in the prior art. A dielectric shift sensing patient occupancy monitoring system is described in detail in U.S. Pat. No. 6,025,782 issued to Newham on Feb. 15, 2000, entitled Device for Monitoring the Presence of a Person using Proximity Induced Dielectric Shift Sensing (the '782 Patent), the full disclosure of which is incorporated herein by reference. Further features of such a system are described in detail in U.S. Pat. No. 6,297,738 issued to Newham on Oct. 2, 2001, entitled Modular System for Monitoring the Presence of a Person using a Variety of Sensing Devices (the '738 Patent), the full disclosure of which is incorporated herein by reference. Further features and accessory components for such a system are also described in detail in U.S. Pat. No. 6,778,090 issued to Newham on Aug. 17, 2004, entitled Modular System for Monitoring the Presence of a Person using a Variety of Sensing Devices (the '090 Patent), the full disclosure of which is incorporated herein by reference.

While the sensors of some of the cited references above function in a manner similar to the sensor of the present invention, the bed and chair sensors described do not easily translate over to a toilet structure where every interaction with the sensor by the individual will likely involve direct contact with water from the toilet and/or urine from the individual using the toilet. In addition, significant improvements to the functionality of the interconnect module are described herein that improve performance of the system, especially in association with a wet environment location, such as a toilet, where quantities of moisture proximate to the sensors might mask or alter dielectric shift readings.

SUMMARY OF THE INVENTION

The present invention provides a sensor and a monitoring system for implementation on a toilet seat to detect: (a) the presence of an individual on the toilet seat; (b) the departure of the individual from the toilet seat; and (c) an overly long occupancy of the toilet seat by the individual. The sensor of the present invention is incorporated either on the underside of the toilet seat or within the material structure of the seat. Included with the sensor of the present invention is an integrated interconnect component for allowing the operation of dielectric shift sensor elements with a variety of control monitors associated with existing patient and nurse call alarm systems. The interconnect component and an appropriately structured interconnect cable are used to connect the dielectric shift sensor configured within or on the toilet seat with any of a variety of different existing alarm/alert control unit modules as utilized in conjunction with patient occupancy alarm systems. Improved interconnect component functionality provides for accuracy of the system even within a damp environment such as a toilet seat.

DETAILED DESCRIPTION OF THE PREFERRED EMBODIMENTS

Figure 1:
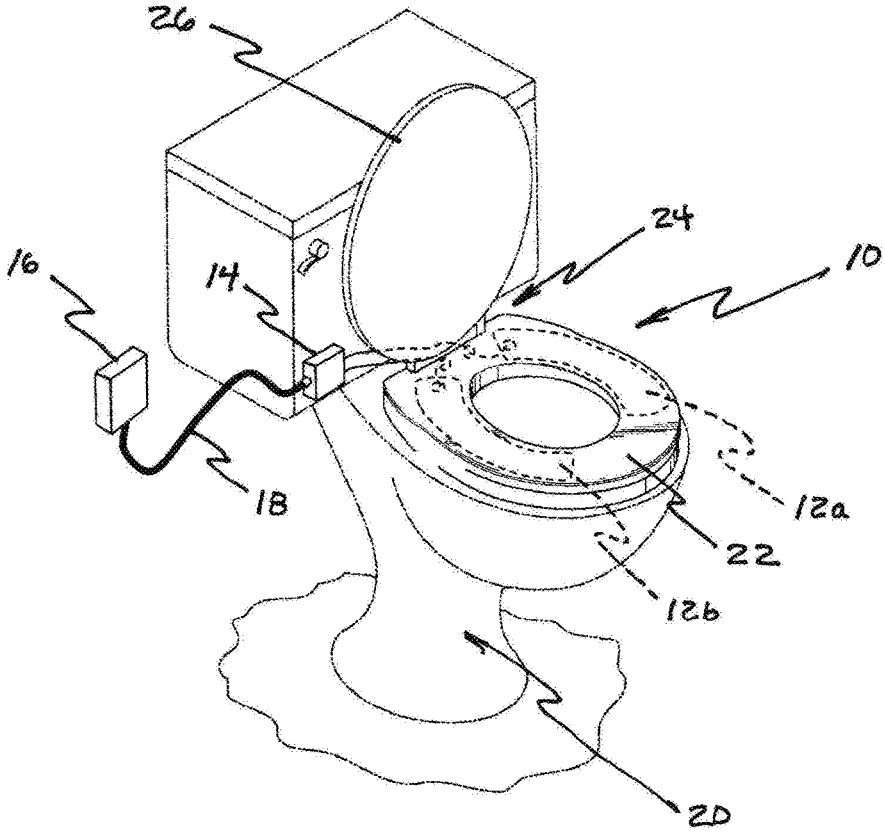
FIG. 1 is a perspective view of a typical toilet shown with the toilet seat down and the toilet lid up, showing in broken lines the sensor elements of the present invention as well as the modular interconnection components and cables of the system.

Reference is made first to FIG. 1 for a description of the basic components of the system of the present invention installed on and used with a typical toilet structure 20. Sensor system 10 is made up primarily of conductive sensor arms 12*a* & 12*b* configured on the underside of toilet seat ring 22. In an alternate embodiment, sensor arms 12*a* & 12*b* are molded into or sandwiched between the material(s) that make up the toilet seat ring.

Toilet seat ring 22 is connected to the toilet 20 and to toilet seat lid 26 at hinged attachment 24. Electrical connections (described in more detail below) between sensor arms 12*a* & 12*b* provide electrical snap on connectors with wire conductors to connect with the system interconnect module 14. Interconnect module 14 is then connected to an existing alert or nurse call system device 16 by way of an appropriately structured interconnect cable 18.

In the manner of installation shown in FIG. 1, the system of the present invention includes no pressure switches or other mechanical motion components and avoids interference with any of the standard parts of the toilet. In addition, the sensor of the system of the present invention is generally removed from direct contact with water from the toilet or contaminating fluids that would require the sensor be frequently cleaned or sanitized. Once interconnect module 14 is removed from attachment to the sensor, the toilet seat with sensor may be cleaned and sanitized with the ordinary course of bathroom cleaning.

Figure 2:
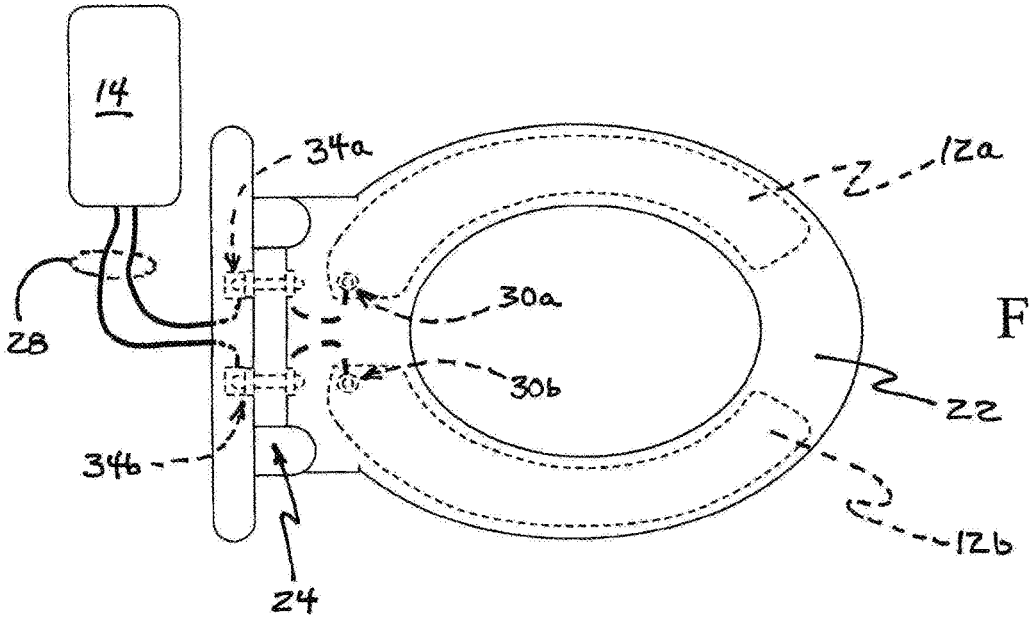
FIG. 2 is a top plan view of a toilet seat integrated with the sensor of the present invention connected to the interconnect module of the system.
Figure 3:
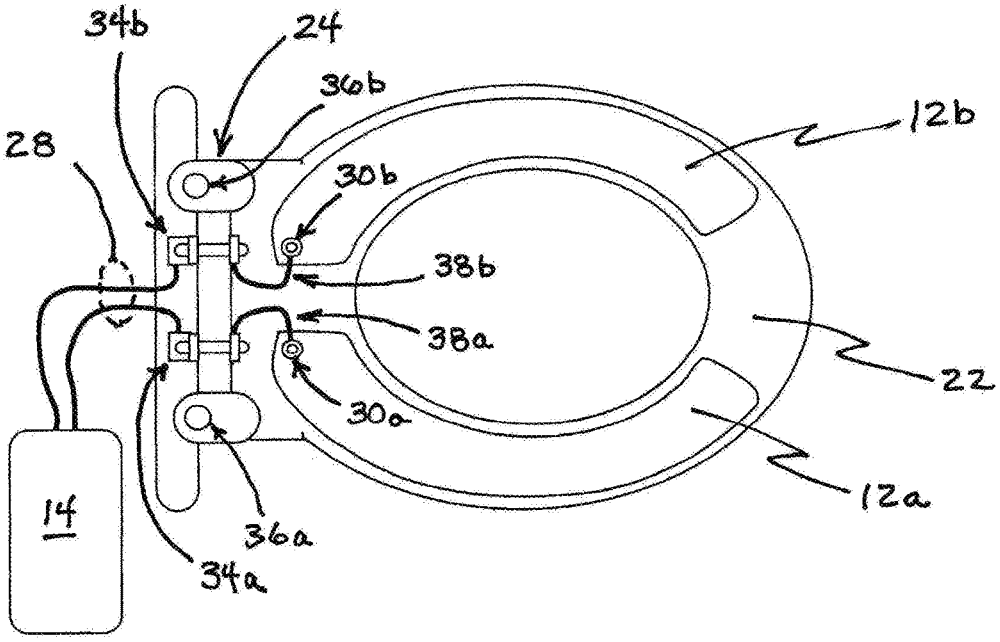
FIG. 3 is a bottom plan view of a toilet seat integrated with a first preferred embodiment of the sensor of the present invention connected to the interconnect module of the system.

FIGS. 2 & 3 show top and bottom views (respectively) of the sensor device 10 of the present invention structured within a typical toilet seat 22. Sensor system 10 is again shown to be made up primarily of conductive sensor arms 12*a* & 12*b* configured on the underside of toilet seat ring 22. Sensor arms 12*a* & 12*b* are constructed of any type of conductive layer; in the form of a metallic sheet or film adhered to the underside of the toilet seat ring, or a layer of conductive ink (metallized or carbon based) sprayed on the underside of the toilet seat ring. With the use of any of these sensor elements; a conductive sheet, a conductive film, or a layer of conductive ink, it is preferred to cover the conductive material with a coating to further protect the sensor from water or other contaminants. All electrical connections associated with the system should likewise be sealed against fluids and other contaminants.

At the hinge 24 end of toilet seat ring 22 the ends of sensor arms 12*a* & 12*b* include wire connection terminals 30*a* & 30*b*. Wire conductors 38*a* & 38*b* extend from these terminals 30*a* & 30*b* to through-bolts in the hinge assembly of the toilet seat to present snap connector post terminals 34*a* & 34*b*. Wire conductors 28 then electrically connect to the interconnect module 14 of the system as described above. Hinge 24 attaches the toilet seat (ring and lid) to the toilet with typical attachment bolts 36*a* & 36*b*.

Toilet seat ring 22 is connected to the toilet 20 and to toilet seat lid 26 at hinged attachment 24. Electrical connections (described in more detail below) between sensor arms 12*a* & 12*b* provide electrical snap on connectors with wire conductors to connect with the system interconnect module 14. Interconnect module 14 is then connected to an existing alert or nurse call system device 16 by way of an appropriately structured interconnect cable 18. Positioning of the electrical connectors and terminals as shown prevents the installed system from interfering with the ordinal function of the toilet seat and lid.

Figure 4A:
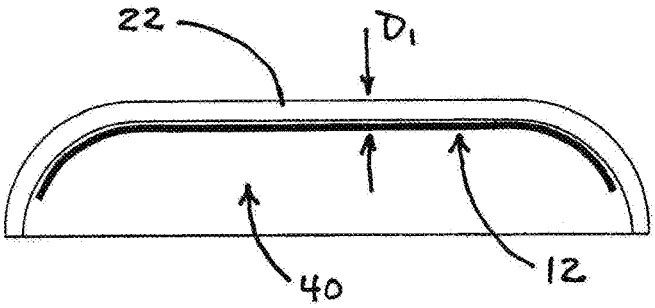
FIGS. 4A & 4B are cross-sectional views of the first (FIG. 4A) and second (FIG. 4B) preferred embodiments of the sensor of the present invention configured on two different types of toilet seat structures.
Figure 4B:
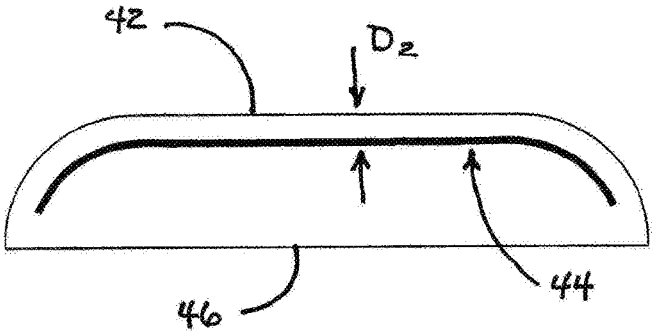

Once again, FIGS. 4A & 4B are cross-sectional views of the first (FIG. 4A) and second (FIG. 4B) preferred embodiments of the sensor of the present invention configured on two different types of toilet seat structures. FIG. 4A shows the conductive layer of sensor 12 positioned on the underside of a structurally "hollow" toilet seat ring 22. Such plastic toilet seats are quite common and generally present no more than a quarter inch thick plastic shell with open space 40 through which the application or placement of the sensor may be made during manufacture or as a retrofit assembly. This thickness dimension $D_1$ may be in the range of one eighth to one quarter inch for the system to function optimally. Through this layer of material, the sensor is capable of detecting a moderate dielectric shift (indicating a change in the presence or absence of a normal sized individual on the toilet seat).

FIG. 4B shows the conductive layer 44 of the sensor positioned internal to the material construction of an alternate type of toilet seat 42. This type of toilet seat ring provides a solid construction 46 that is too thick for the conductive layer to be simply sprayed on or adhered to the bottom of the ring. In this case, the conductive layer 44 is molded into the material of the seat or is sandwiched between two layers of material that make up the solid construction of the toilet seat. In either case, thickness dimension $D_2$ is again preferably in the range of one eighth to one quarter inch for the system to function properly.

Figure 5:
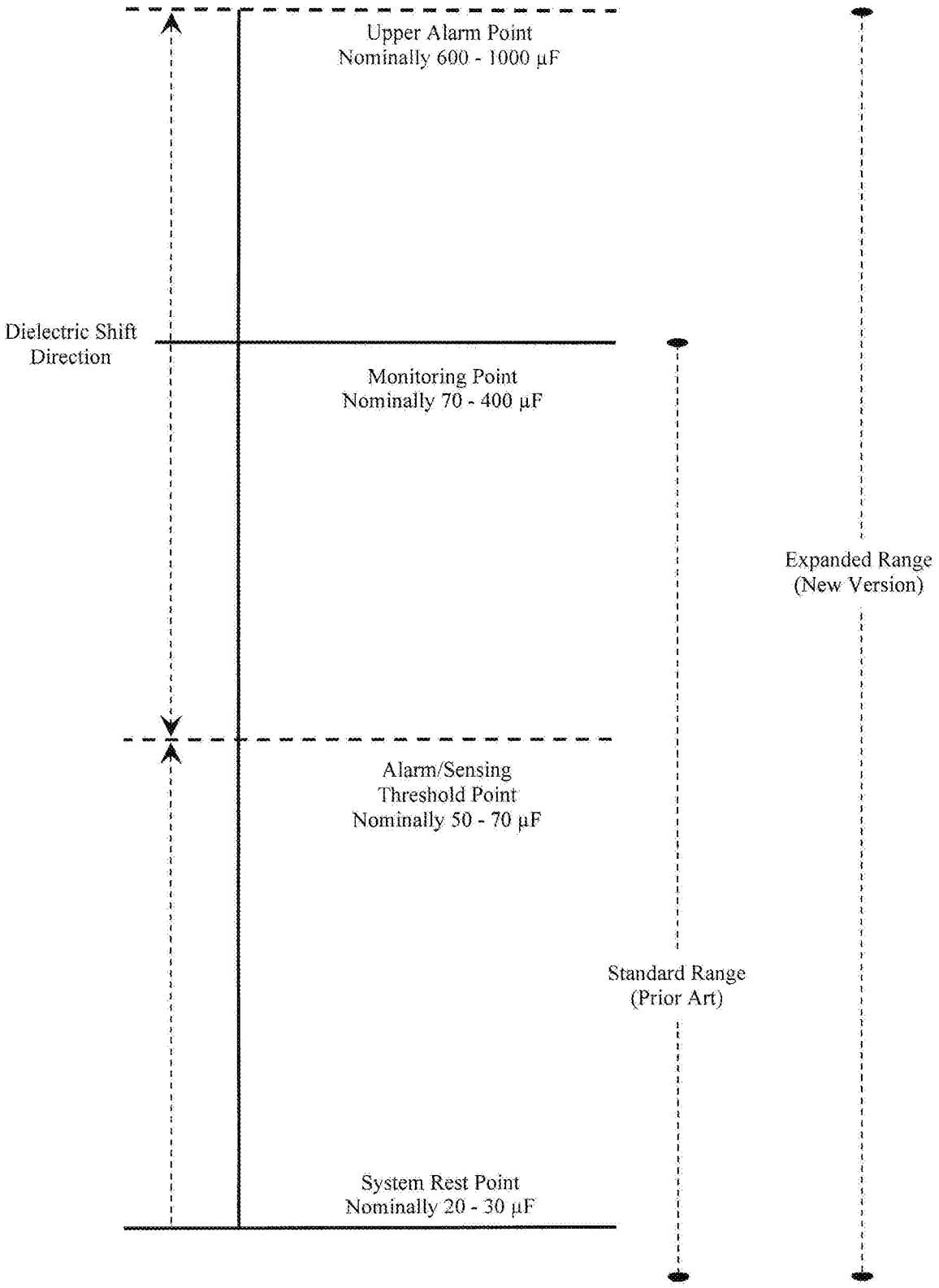
FIG. 5 is a graphic representation of the improved functionality of the interconnect module of the present invention in comparison to previous dielectric shift measurement systems.

Reference is finally made to FIG. 5 for a graphic representation of the improved functionality of the interconnect module of the present invention in comparison to previous dielectric shift measurement systems. Earlier versions of the interconnect module (as described in the prior art references cited above and incorporated by reference) were encapsulated circuits with permanently attached connecting cables that were typically powered by the monitor to which it would be attached. A subsequent version of the interconnect module was developed to overcome the restrictions imposed by having a permanently attached connecting cable and being powered by the connected monitor (which generally would have required the production of several models to accommodate the many alarm monitor brand internal variations in connecting cable wiring, monitor output polarity and variations in voltage etc.). This subsequent version of the interconnect module included a conformal coated circuit board powered by its own on-board battery making it effectively generic to manufacture as the required connecting cable variants were detachable. This made the combined systems where dielectric shift sensing was used considerably lower in cost to manufacture and provided connectivity to any brand of alarm monitor regardless of its output power and/or connection variables. The dielectric shift sensing devices described in the references mentioned above generally used flexible, replaceable sensor elements that monitored a patient's presence or absence from a bed, a chair, or a wheelchair.

In addition, the alarm sensing capability of the subsequent version of the interconnect module was significantly more adaptive in its sensing than the original version in that its embedded operating software exclusively looked for any sudden downward dielectric shift (indicating the patient's exit from the sensor mat) from its monitor mode activation point, regardless of what that point may be in terms of capacitive output of the attached sensor mat (which can vary depending on the patient's body mass, the placement/positioning of the mat and the underlying substrate patient support structure type and materials). See the Standard Range (Prior Art) range indicated in FIG. 5.

In addition to all of the features of the initial and subsequent versions of the interconnect module, the improved version of the interconnect module described herein expands the clinical capability of interconnect module by making it a dual-function alarm generation unit. In addition to the embedded operating software looking for any sudden downward dielectric shift from its monitor-mode point (to indicate a likely patient exit), the software will also look for any significant upward dielectric shift to generate an alarm mode. See the Expanded Range (New Version) range indicated in FIG. 5. The improved interconnect module establishes a fully floating dielectric shift measurement system whereby the range being measured can automatically shift according to the ambient conditions of the substrate.

The upward shift sensing can be accurately interpreted by the system as a change in the ambient substrate environment affecting the sensor mat. In the case of patient monitoring with sensor mats in beds and chairs, this would most likely be the result of moisture from excessive patient perspiration or enuresis depending on mat placement and positioning. Good clinical practice dictates that no patient should be allowed to remain in conditions where this excess moisture/fluid would cause skin maceration and ultimately the tissue breakdown of pressure sores and decubitus, unfortunately common in many patients/long-term residents confined to bed rest or the use of wheelchairs etc. In the case of patient monitoring with the system of the present invention (presence or absence on a toilet) this change in the ambient substrate environment would most likely be the result of water from the toilet splashing up onto the toilet seat or the accidental urination by the patient onto the toilet seat instead of into the toilet bowl. In general, the improved interconnect module provides measurement functionality that improves performance of the system within environments where dielectric shifts are likely to occur from other than patient movement on and off the sensor.

Therefore, when the improved interconnect module of the present invention generates an alarm, the caregiver could anticipate either a patient exit maneuver or if the patient is still in position, conditions where the patients skin surface may be at risk and requiring appropriate nursing action. As both risk of falls (especially around a toilet) and decubitus are two of the most common preventable patient care issues in healthcare facilities this improved interconnect module of the present invention helps solve both concerns simultaneously.

Although the present invention has been described in conjunction with a number of preferred embodiments, those skilled in the art will recognize modifications to these embodiments that still fall within the scope of the present invention. Beyond the basic components specified in the preferred embodiments, other toilet seat configurations (such as an open arch seat rather than a closed ring) and a variety of alert/alarm devices are anticipated. While the preferred embodiments have focused on two common types of toilet seats, the basic concepts of the sensor and system described translate easily into other toilet seat structures. Implementation of the system of the present invention could easily be made on toilet seat risers designed to facilitate the process of sitting down on and standing up from the toilet by the elderly or infirm. Given that the sensor elements of the system must be in proximity to the top surface of the toilet seat, such toilet seat riser implementations would be based on the structure shown in FIG. 4B.

The system of the present invention could likewise be implemented on bedside commodes and stand alone raised toilet seats. The toilet seat configurations in such devices would generally require structuring the sensor elements in the manner shown in FIG. 4A. Because the system measures dielectric shift the exact geometry (area and thickness) of the sensor element is not as critical as the thickness of the substrate material between the conductive sensor element and the individual seated on the toilet.

Although the preferred embodiments of the present invention describe placement of the sensor element either underneath the seat structure (as in FIG. 4A) or within the material of the seat itself (as in FIG. 4B), it is possible to adhere a sensor element to the top of the toilet seat structure and cover over the sensor element with a thick and durable coating. Modification of the wire connection terminals on the sensor arms would be made to place such connection points well away from and thoroughly sealed from contact with the individual seated on the toilet. As described in the references mentioned above, the electronic elements of the system of the present invention operate at extremely low voltages (the interconnect module may preferably utilize a low voltage battery) and therefore present no risk of shock to the user. Because the dielectric shift being measured is a proximity field induced effect there is no requirement for higher voltages or direct contact with the sensor elements.

In addition, the modular components of the system of the present invention, while based generally on the modular components and cables described in the above referenced prior art, may be modified and/or programmed to accommodate the specific materials and geometries of different toilet seats. None of these modifications are seen to depart from the spirit and scope of the present invention.

I claim:

1. A sensor for monitoring a change in the presence or absence of a person seated on a toilet, the toilet having a toilet seat with a full or partial ring structure and a hinged attachment structure securing it to the toilet, the sensor comprising:

first and second electrically conductive elements, the first conductive element extending in an arc at least partially around one side of the toilet seat ring and the second conductive element extending in an arc in a direction opposite the first element at least partially around a second side of the toilet seat ring, the first and second conductive elements each further comprising electrical connection terminals;

a pair of electrical conductors, connected to the terminals of the conductive elements; and a pair of electrically conductive through-bolts extending through the hinged attachment structure of the toilet seat connecting the pair of electrical conductors to external snap connectors, the external snap connectors positioned in an externally accessible location at a rearward facing side of the toilet seat.

2. A system for monitoring the presence or absence of a person seated on a toilet, the toilet having a toilet seat with a full or partial ring structure and a hinged attachment structure securing it to the toilet, the system comprising:

a toilet seat sensor, the toilet seat sensor comprising:

first and second electrically conductive elements, the first conductive element extending in an arc at least partially around one side of the toilet seat ring and the second conductive element extending in an arc in a direction opposite the first element at least partially around a second side of the toilet seat ring, the first and second conductive elements each further comprising electrical connection terminals;

a pair of electrical conductors, connected to the terminals of the conductive elements; and a pair of electrically conductive through-bolts extending through the hinged attachment structure of the toilet seat connecting the pair of electrical conductors to external snap connectors, the external snap connectors positioned in an externally accessible location at a rearward facing side of the toilet seat; and an interconnect module having an input connected to the external snap connectors on the toilet seat sensor, the interconnect module having electronic circuitry for measuring a dielectric shift between the conductive elements of the toilet seat sensor, the interconnect module further having an output for wired or wireless connection to an existing nurse call alert/alarm system.

* * * * *